US006609345B2

(12) United States Patent
Schauf, Sr. et al.

(10) Patent No.: US 6,609,345 B2
(45) Date of Patent: Aug. 26, 2003

(54) STRUCTURAL MEMBER AND METHOD OF MANUFACTURING SAME

(75) Inventors: Mitchell Earl Schauf, Sr., Gainesville, TX (US); Ronald L. Ross, Gainesville, TX (US)

(73) Assignee: Petroflex, N.A., Inc., Gainesville, TX (US)

( * ) Notice: Subject to any disclaimer, the term of this patent is extended or adjusted under 35 U.S.C. 154(b) by 199 days.

(21) Appl. No.: 09/752,997

(22) Filed: Jan. 3, 2001

(65) Prior Publication Data

US 2003/0041553 A1 Mar. 6, 2003

Related U.S. Application Data

(63) Continuation-in-part of application No. 09/306,506, filed on May 6, 1999, now Pat. No. 6,367,226.

(51) Int. Cl.[7] ..... E04H 12/24

(52) U.S. Cl. ..... 52/736.2; 52/736.3; 52/40; 52/309.4; 52/309.15; 428/327; 428/500

(58) Field of Search ..... 52/309.4, 309.7, 52/309.15, 40, 736.2, 736.3, 737.2, 737.4, 737.6, 309.1; 428/500, 323, 327

(56) References Cited

U.S. PATENT DOCUMENTS

| | | | | | |
|---|---|---|---|---|---|
| 5,573,348 | A | * | 11/1996 | Morgan | 405/52 |
| 5,583,729 | A | * | 12/1996 | Hassler et al. | 361/39 |
| 5,605,017 | A | * | 2/1997 | Fingerson et al. | 52/40 |
| 5,725,940 | A | * | 3/1998 | Sakai et al. | 428/318.6 |
| 5,775,035 | A | * | 7/1998 | Papin | 52/100 |

* cited by examiner

*Primary Examiner*—Carl D. Friedman
*Assistant Examiner*—Jennifer I. Thissell
(74) *Attorney, Agent, or Firm*—Mark E. Brown

(57) ABSTRACT

A structural member comprises a plastic base material with fiber reinforced plastic fill material. A gas producing substance or foaming agent is mixed with the base material and provides a lower density within the interior of the member. The structural member can comprise one or more of the components of a utility pole assembly, such as the crossarms, bracing, insulators and pole. A method of producing the structural member includes the steps of mixing additives with plastic pellets for feeding into an extruder. The extruded structural members are formed, cooled, pulled and cut to desired lengths.

17 Claims, 9 Drawing Sheets

STRUCTURAL MEMBER AND METHOD OF MANUFACTURING SAME

CROSS-REFERENCE TO RELATED APPLICATION

This application is a continuation-in-part of application Ser. No. 09/306,506, filed May 6, 1999 now U.S. Pat No. 6,367,226.

BACKGROUND OF THE INVENTION

1. Field of the Invention

The present invention relates generally to structural members, and in particular to plastic structural members for utility pole components, railroad ties and other applications.

2. Description of the Prior Art

Structural members have been made from various materials in order to withstand the environments in which they are installed. For example, utility poles are in widespread use for suspending utility lines, including electrical power, telephone/data, etc., at safe distances above the ground. Utility pole structural members have traditionally been manufactured predominately of wood, which has the advantages of being relatively ubiquitous, inexpensive, nonconductive, and generally at least adequate as a structural material with desired strength characteristics.

Other structural compositions for utility pole structural members include reinforced concrete, prestressed concrete, steel, aluminum, fiberglass and rigid plastic. For example, the Papin U.S. Pat. No. 5,775,035 discloses a power pole composed of rigid plastic structural members. The Sakai et al. U.S. Pat. No. 5,725,940 discloses a structure and method for making composite molded articles. The structures disclosed therein are generally molded, pulltruded and cast. They can be constructed with hollow, foam-filled and fiberglass honeycomb cores. Such structures and their manufacturing techniques tend to be relatively expensive or suffer from other drawbacks and disadvantages.

Disadvantages of wood include its susceptibility to damage from insects, birds, termites, etc. Wood is also subject to attack by biological organisms, particularly in humid environments. Still further, wood tends to deteriorate when exposed to the elements, such as ultraviolet radiation, precipitation, humidity, temperature cycles, etc. These and other factors have the cumulative effect of reducing the useful lives of wooden structural members which are exposed to the elements.

Disadvantages are also associated with other structural materials. For example, metals are subject to rust and corrosion. Moreover, their electrical conductivity generally makes them unsuitable for electrical utility pole construction requiring insulative properties. Materials which are hollow or porous are often unsuitable for exterior construction because they tend to admit water which can damage the structural members. Moreover, water permeation tends to increase electrical conductivity, making such materials unsuitable for electrical utility structures.

Other disadvantages associated with prior art structural materials include susceptibility to deformation and breaking when subjected to significant loads, both static and dynamic. Special tools and assembly techniques associated with some structural members can further increase the cost of construction and maintenance. Still further, a common practice involves coating exposed wooden structural members with a preservative, such as creosote. However, environmental laws and regulations significantly limit the permitted uses of wood preservatives, particularly those that contain toxins.

Plastic is often used as a replacement material for wood. For example, recycled plastic/composite railroad crossties have been substituted for wooden railroad crossties.

Although plastic materials tend to repel or resist water and are nonconductive, their disadvantages include vulnerability to ultraviolet radiation, higher densities as compared to wood, and cost. The present invention addresses some or all of the disadvantages and limitations associated with prior art structural members, including wooden and plastic utility pole crossarms and crossarm assemblies.

Heretofore there have not been available structural members or methods of manufacturing same with the advantages and features of the present invention.

SUMMARY OF THE INVENTION

In the practice of the present invention, a structural member, such as a utility pole crossarm, is manufactured from a plastic material and has a relatively dense outer surface and a less dense core. A crossarm assembly includes a plastic crossarm and a pair of diagonal braces for supporting the crossarm on the utility pole. Other utility pole components adapted for plastic construction according to the present invention include cross braces, insulators and the poles themselves. The structural members can be homogenous throughout with respect to their material composition. Other structural member applications include railroad ties.

A method of manufacturing the structural members includes extruding a continuous band comprising a polypropylene base material, a fiber reinforced plastic fill material, and a blowing or foaming agent. Additional materials can include chopped glass fibers, UV inhibitors, light stable pigments, antioxidant additives, processing aids, recycled materials, and endothermic gas producing agents. The materials are combined and extruded to form a continuous band, which is shaped and cooled in several stages and cut to predetermined lengths to form the structural members.

OBJECTS AND ADVANTAGES OF THE INVENTION

The principal objects and advantages of the present invention include: providing plastic structural members; providing such structural members which are adaptable to various applications; providing such structural members which are usable in constructing a wide variety of external structures; providing such structural members which are resistant to static and dynamic loads; providing such structural members which are resistant to environmental damage; providing such structural members which can be cut, drilled and assembled in the field using common tools and procedures; providing such structural members which meet all applicable regulatory requirements; providing such structural members which are adaptable for use as railroad ties; providing a plastic crossarm for utility poles; providing such a crossarm which is resistant to the elements; providing such a crossarm which is resistant to pest damage; providing such a crossarm which meets or exceeds the strength specifications for wooden crossarms; providing such a crossarm which weighs approximately the same amount as a comparable wood crossarm; providing such a crossarm which can be cut, drilled, etc. with tools used for working on wooden crossarms; providing such a crossarm which utilizes recycled plastic; providing a crossarm assembly with a plastic crossarm and plastic braces; providing such a crossarm assembly which is capable of passing lightning impulse tests associated with utility pole applications; providing such a crossarm assembly which meets or exceeds electrical insulation levels required for utility pole applications; providing such a crossarm which is economical to manufacture, efficient in operation, capable of a long operating life and particularly well adapted for the proposed usage thereof; and providing a method of manufacturing plastic structural members.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof

DETAILED DESCRIPTION OF THE PREFERRED EMBODIMENTS

I. Introduction and Environment

Figure 1:
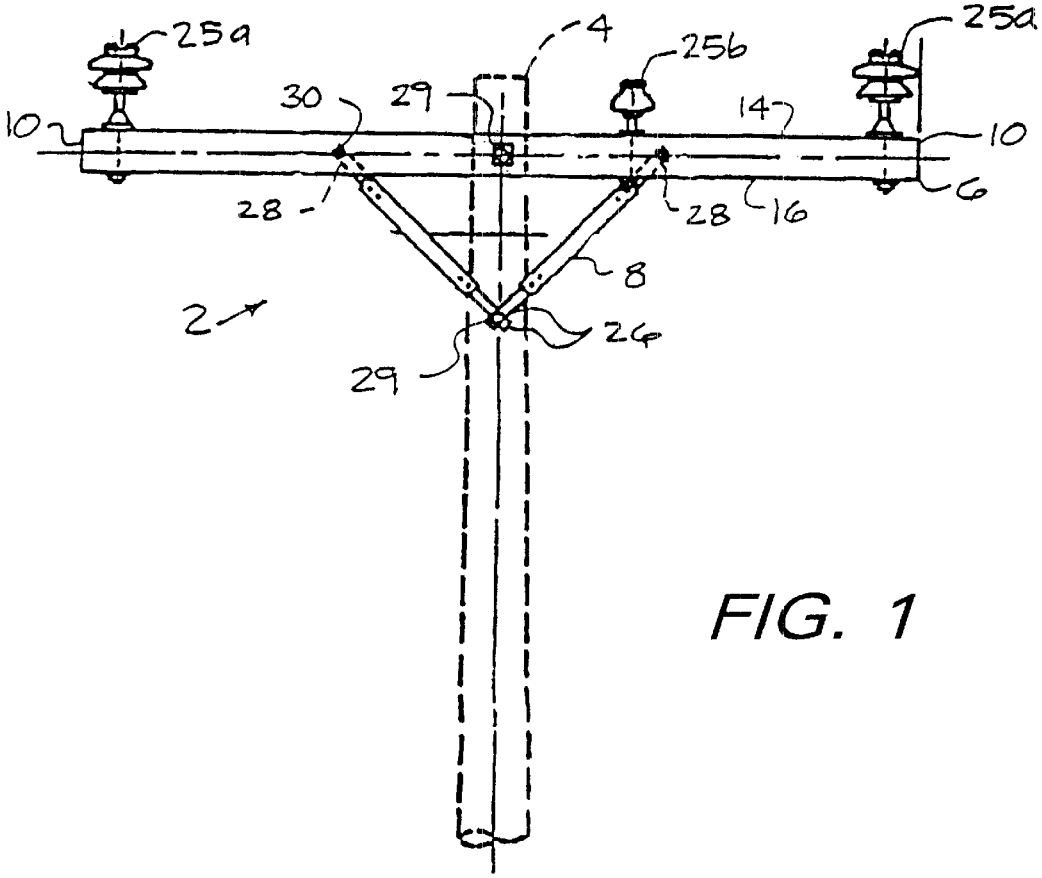
FIG. 1 is a fragmentary, vertical, elevational view of a utility pole assembly including a crossarm and crossarm assembly embodying the present invention; the pole is shown in broken lines.
Figure 2:
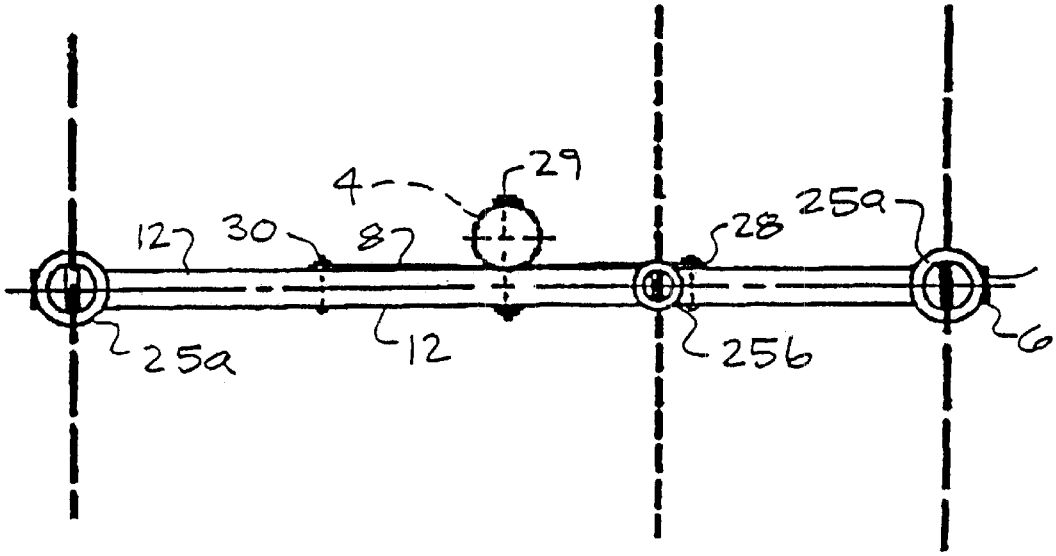
FIG. 2 is a top plan view thereof.
Figure 3:
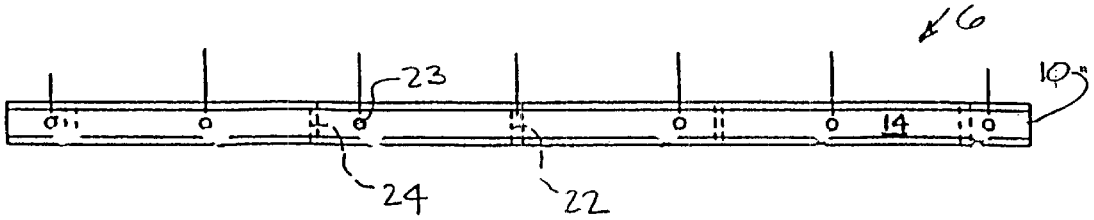
FIG. 3 is a top plan view of a crossarm embodying the present invention.
Figure 4:
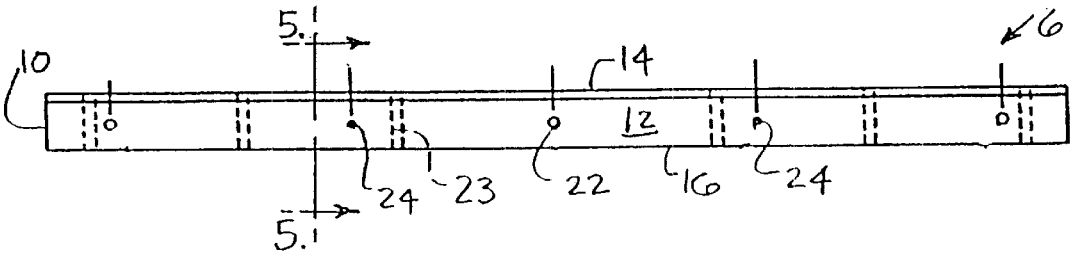
FIG. 4 is an elevational view thereof.
Figure 5:
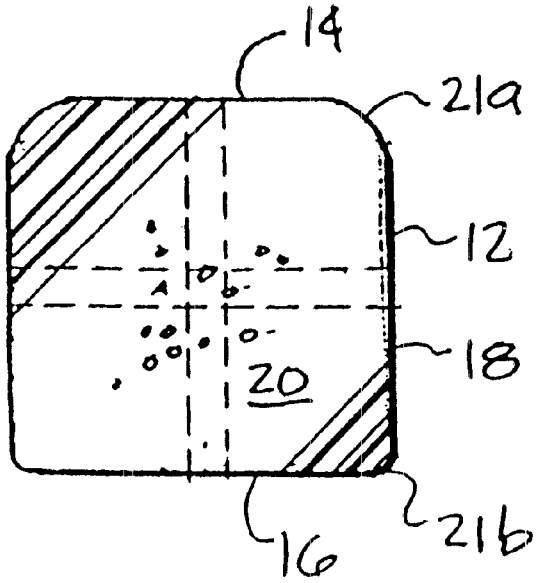
FIG. 5 is a vertical, cross-sectional view thereof, taken generally along line 5—5 in FIG. 4.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a crossarm assembly embodying the present invention and mounted on a utility pole 4. "Crossarm" as used herein includes a wide variety of structural members mounted on utility poles, including buckarms, twinarms, dead ends, etc. The crossarm assembly 2 generally includes a crossarm 6, a pair of diagonal braces 8 and insulators 25*a,b*.

II. Crossarm 6

The crossarm 6 includes opposite ends 10, opposite side faces 12, and top and bottom faces 14, 16. The crossarm 6 includes an outer surface 18 and an inner core 20. The core 20 includes entrained voids which are formed by a foaming or blowing agent introduced into the plastic and fiber reinforced plastic base and fill materials in the manufacturing process, as described below. The core 20 is thus less dense than the outer surface 18. A medial, horizontal bolt or pin hole 22 extends between and is open at the side faces 12. Multiple lateral, horizontal holes 24 also extend between and are open at the side faces 12. Each lateral hole 24 is located between a respective crossarm end 10 and the medial bolt hole 22. Vertical holes 29 can be provided at suitable locations in the crossarm 6, for example, at spaced locations for mounting electrical insulators 25*a,b,* hangers, etc. The crossarm 6 includes radiussed upper and lower edges 21*a,b*.

III. Braces 8

Each brace 8 includes inner and outer ends 26, 28. The brace inner ends 26 are 9 mounted on the utility pole 4 by a brace/pole mounting bolt 29. The brace outer ends 28 are mounted on the crossarm 6 by brace/crossarm mounting bolts 30 extending through brace outer ends 28 and respective lateral bolt holes 24.

IV. Crossarm Manufacturing Method

Figure 6:
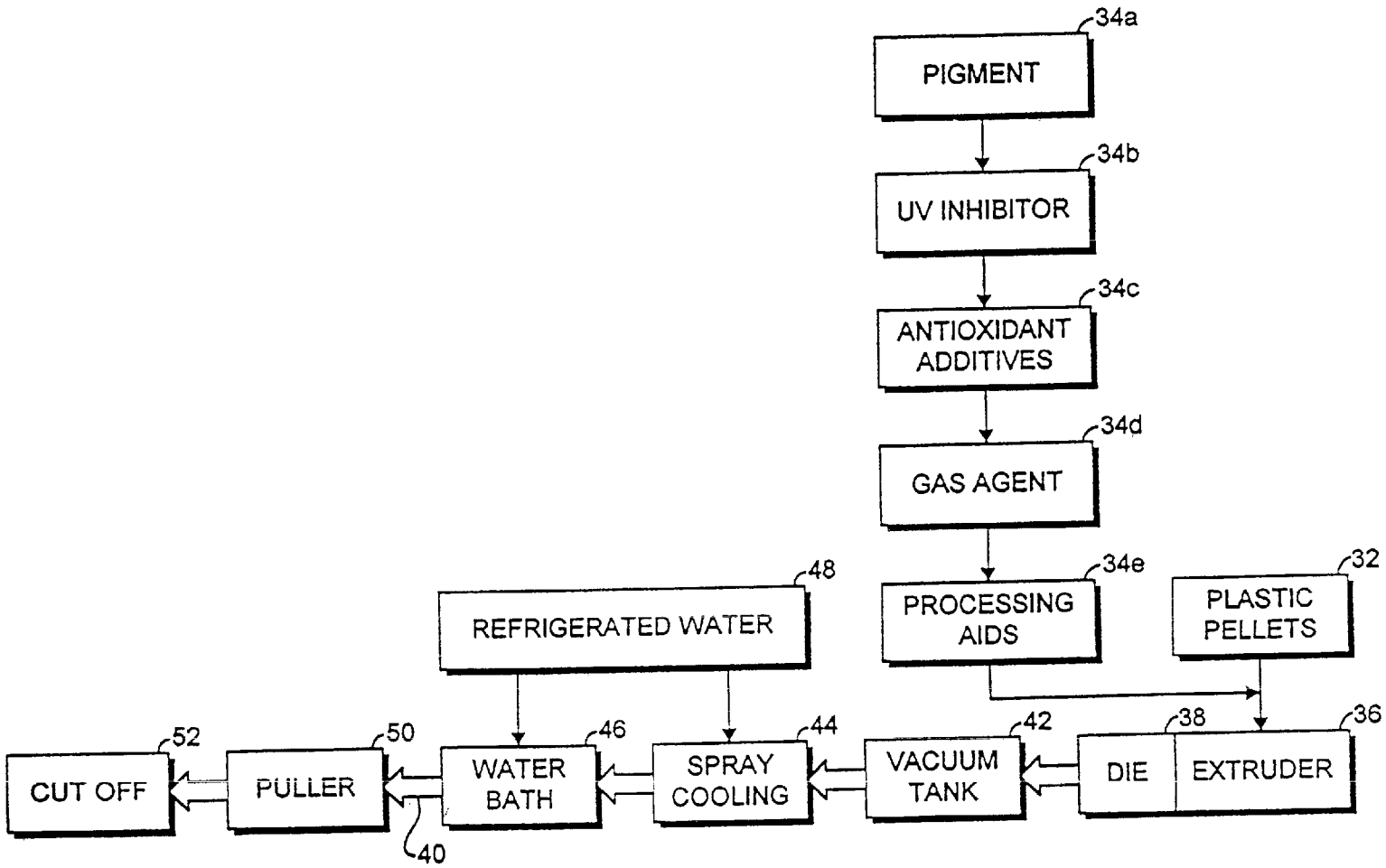
FIG. 6 is a block schematic of a system for practicing a method of manufacturing a plastic structural member according to the present invention.

FIG. 6 is a schematic diagram showing a system for practicing a method of manufacturing structural members, such as the crossarm 6 and the crossarm assembly 2. The method includes the steps of providing a source 32 of plastic pellets. Without limitation of the generality of useful plastic base materials for the crossarm 2, polypropylene homopolymer base material (e.g., NT-418.T001-8000) with 20% to 30% chopped glass fibers has been found to be particularly suitable for use in the manufacture of the crossarm 6. Additives for the manufacturing process include pigment 34*a,* UV inhibitors 34*b,* and antioxidant additives 34*c*. A foaming agent source 34*d* is also provided and introduces a suitable endothermic foaming or blowing agent, such as Rowa Tracel P02201-P, into the pellet stream from the pellet source 32. Another additive source comprises processing aids 34*e*.

The combination of plastic pellets and foaming agent is introduced into an extruder 36 which can apply mechanical energy and/or heat to the raw material mixture which is forced through a forming dye 38 mounted on the extruder 36. From the dye 38 a continuous band 40 of crossarm stock emerges and enters a vacuum tank which includes a sizer. The stock band 40 is formed to a predetermined size with relatively constant thickness and height dimensions in the vacuum tank 42.

Upon exiting the vacuum tank 42, the band 40 is subjected to an annealing step whereafter it enters a spray cooling tank 44. Upon exiting the spray cooling tank 44, the band 40 is again subjected to an annealing step and enters a second cooling process in a water cooling bath 46 wherein the band 40 is submerged. In the spray cooling tank 44 the band 40 generally floats on the surface of the water and is subjected to continuous spray. In the second water cooling bath 46 the band 40 is submerged. The cooling water is provided by a refrigerated water source 48 whereby its temperature is lowered to approximately 55°. A puller 50 is positioned downstream of the water cooling bath 46 and pulls the band 40 through the production process. Upon exiting the puller 50, the band 40 is cut to predetermined lengths by a cutoff saw 52.

The following test results (Table 1) were obtained in load/deflection testing in accordance with Rural Utility Services (RUS) test requirements. The test procedure involved placing the crossarm in a rigid test frame and securing it at a point fourteen inches from the outermost hole. Upward pulling forces were applied at the outermost hole and deflection measurements were recorded in increments up to a load of 1000 pounds. Loading was then continued until failure occurred. The procedure was performed on both ends of the crossarm. The results of these tests are summarized as follows:

TABLE 1

| Applied Load (lbs) | Test #1/ Deflection (inches) | Test #2/ Deflection (inches) |
|---|---|---|
| 250 | 7/16 | 5/16 |
| 500 | 13/16 | 7/8 |
| 750 | 1 1/4 | 1 3/8 |
| 1000 | 1 3/4 | 1 15/16 |
| Ultimate Load (lbs) | 1925 | 1675 |

V. First Modified Embodiment Railroad Crosstie Structural Member 102

Figure 7:
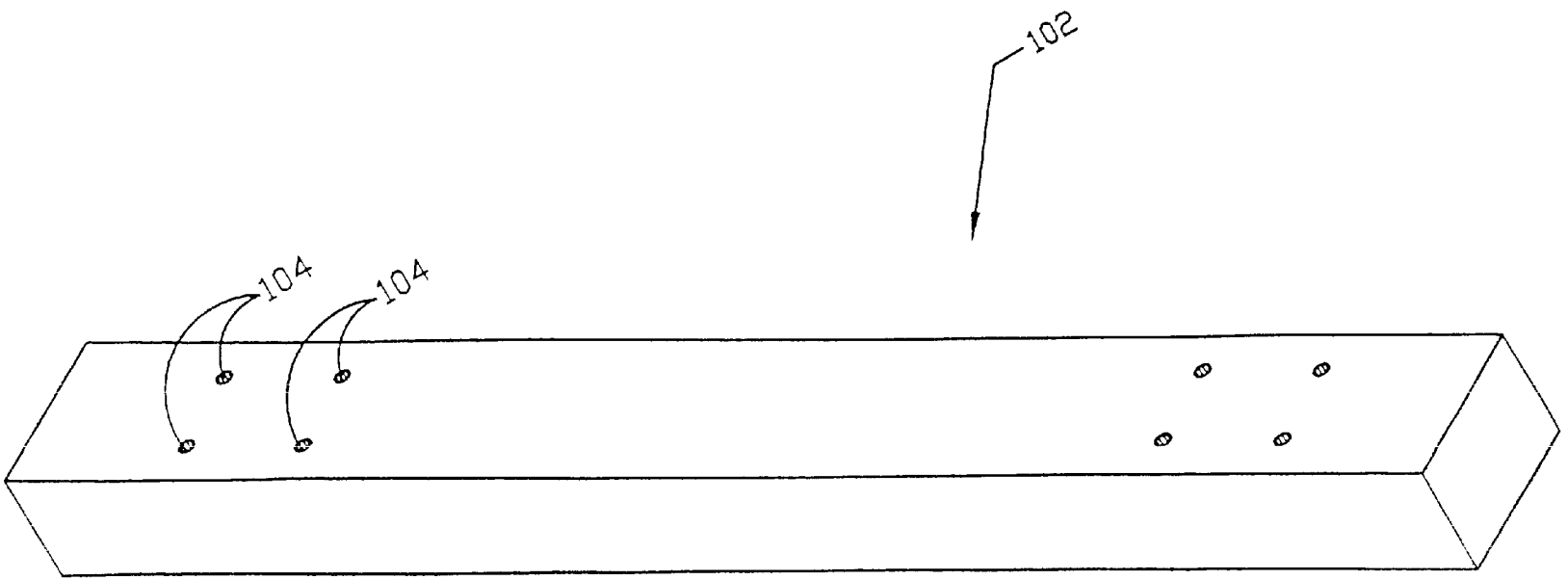
FIG. 7 is a perspective view of a plastic railroad tie comprising a first modified embodiment of the present invention.

A first modified embodiment structural member comprising a railroad crosstie 102 is shown in FIG. 7. The railroad crosstie 102 can be cut off from a continuous length of plastic structural member extruded and processed according to the method described above. The railroad crosstie 102 is provided with holes 104 which can be predrilled for receiving the rail-mounting plates.

VI. Second Modified Embodiment Hollow Structural Member 202

Figure 8:
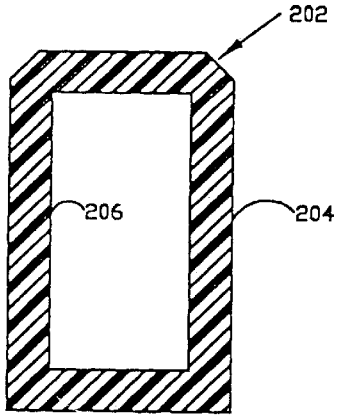
FIG. 8 is a cross-sectional view of a hollow structural member comprising a second modified embodiment of the present invention.

A second modified embodiment structural member is shown in FIG. 8 and is generally designated by the reference numeral 202. The structural member 202 includes a side wall 204 enclosing a hollow passage or core 206. The dimensions and proportions of the side wall 204 with respect to the passage or core 206 can vary considerably. For use as a utility pole crossarm, the thickness of the sidewall 204 can be approximately one inch.

VII. Third Modified Embodiment Filled-Core Structural Member 302

Figure 9:
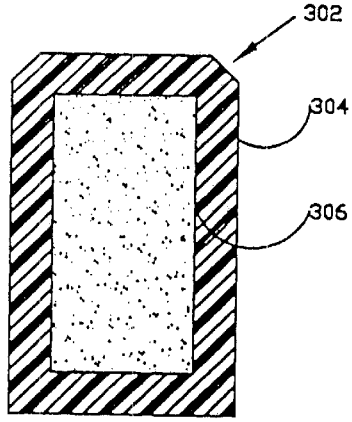
FIG. 9 is a cross-sectional view of a filled-core structural member comprising a third modified embodiment of the present convention.

A structural member 302 comprising a third modified embodiment of the present invention is shown in FIG. 9 and includes a side wall 304 generally enclosing a core 306 comprising a suitable fill material. The fill material comprising the core 306 is preferably chosen for the particular application of the structural member 302. For example, closed-cell foam or expanding foam would be suitable for many applications and would provide a relatively lightweight but strong structural member 302.

VIII. Fourth Modified Embodiment Structural Member 402

Figure 10:
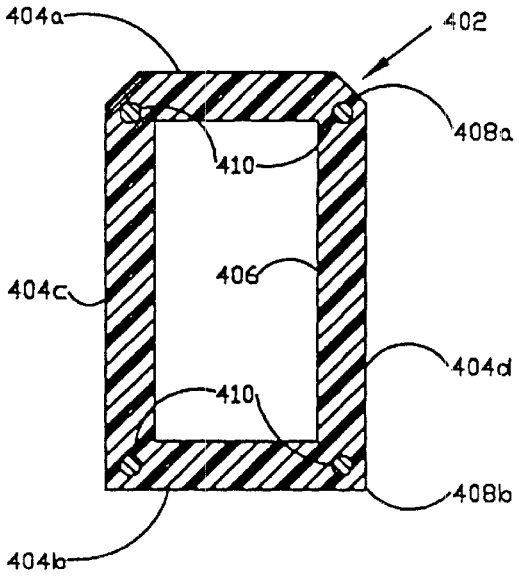
FIG. 10 is a cross-sectional view of a structural member with fiberglass reinforcing rods comprising a fourth modified embodiment of the present invention.

A structural member 402 comprising a fourth modified embodiment of the present invention is shown in FIG. 10. The structural member 402 includes a wall 404 with a generally rectangular cross-sectional configuration defined by upper, lower, first side and second side sections 404*a,b,c,d* respectively. A passage or bore 406 extends longitudinally and can either be hollow (similar to the structural member 202 described above) or filled (similar to structural member 302 described above). The wall sections 404*a,b,c,d* intersect at respective pairs of upper and lower edges 408*a,b*.

In proximity to each edge 408*a,b* a fiberglass reinforcing rod 410 is embedded in the wall 404. The fiberglass reinforcing rods 410 provide tensile strength in proximity to the wall upper and lower sections 404*a,b*. Thus, the reinforced structural member 402 can possess enhanced strength and stiffness as compared to unreinforced structural members.

IX. Fifth Modified Embodiment Structural Member 502

Figure 11:
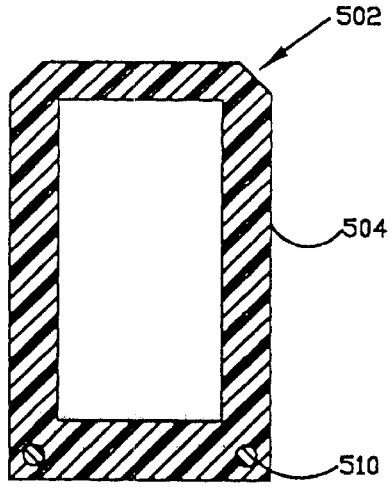
FIG. 11 is a cross-sectional view of a structural member with fiberglass reinforcing rods comprising a fifth modified embodiment of the present invention.

A structural member 502 comprising a fifth modified embodiment of the present invention is shown in FIG. 11 and includes a wall 504 with upper, lower, first side and second side sections 504*a,b,c,d* respectively. The lower wall section 504*b* is thicker than the other sidewall sections 504*a–c*. Fiberglass reinforcing rods 510 are embedded within the wall lower section 404*b* and provide greater strength and rigidity. In particular, he reinforcing rods 510 provide stiffness and strength to resist bending loads applied perpendicularly to the upper and lower wall sections 504*a* and 504*b* respectively.

X. Modified Embodiment Method Utilizing Co-extrusion

Figure 12:
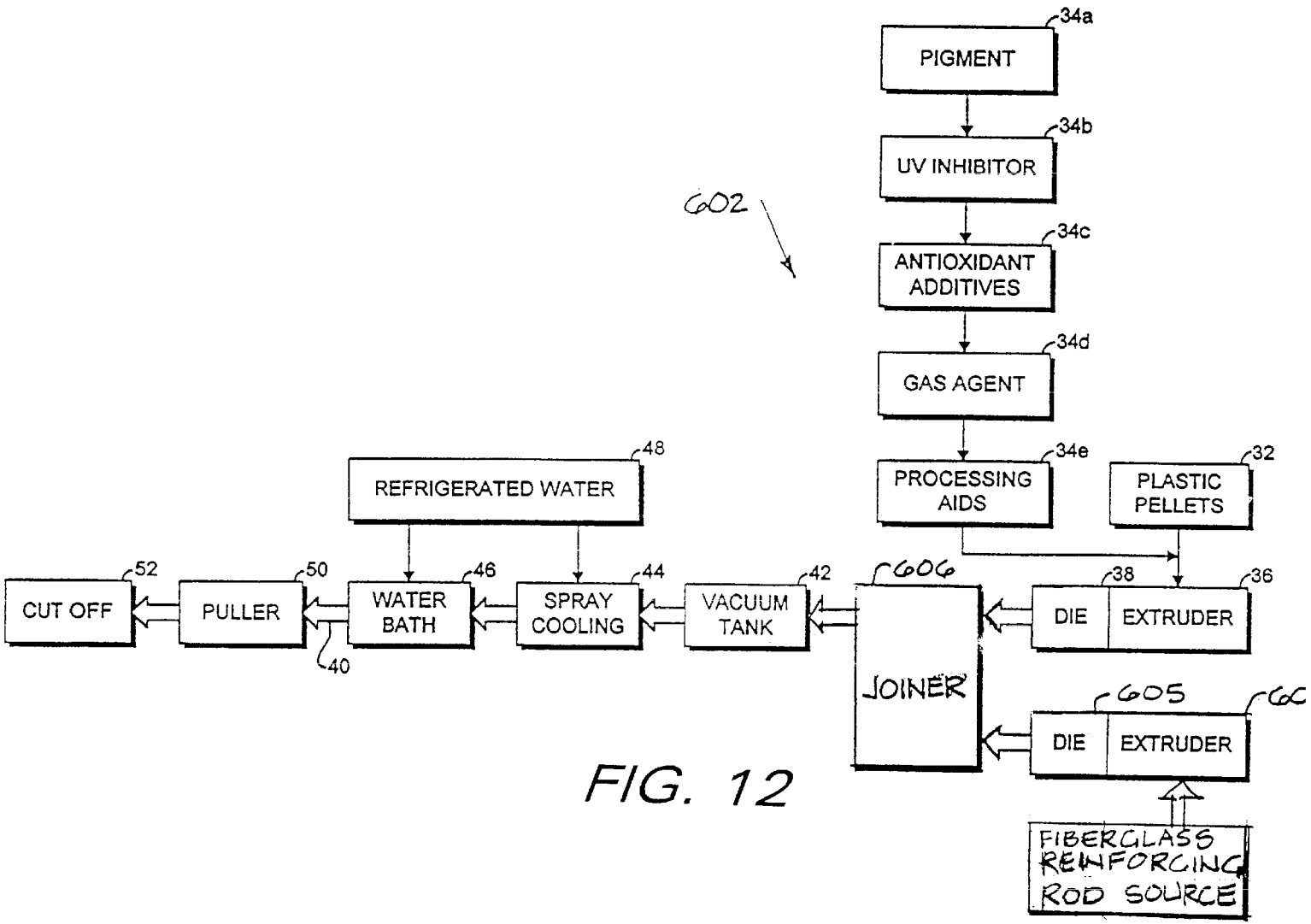
FIG. 12 is a schematic diagram showing a system for practicing a modified method of the present invention whereby fiberglass reinforcing rods are co-extruded into the structural member.

FIG. 12 shows a system 602 for practicing a modified method of the present invention. In addition to the other components of the system shown in FIG. 6, The system 602 includes an additional extruder 604. The additional extruder 604 extrudes fiberglass reinforcing rods 410 or 510, which enter a joiner 606 for embedding same in the structural member walls 404*a–d* or 504*a–d*. The system 602 can be configured in various ways to produce reinforced plastic structural members of various desired configurations.

It is to be understood that while certain forms of the present invention have been illustrated and described herein, it is not to be limited to the specific forms or arrangement of parts described and shown. For example, it will be appreciated that a wide variety of other structural members can be formed with and according to the present invention.

What is claimed and desired to be secured by Letters Patent is as follows:

1. A structural member, which comprises:

(a) an outer surface;

(b) an inner core;

(c) a polypropylene base material;

(d) a fiber reinforced plastic fill material mixed with the base material, said fill material comprising 10% to 30% of said base material;

(e) a foaming agent mixed with the base and fill materials;

(f) said inner core having entrained air pockets distributed throughout same; and (g) said structural member having a greater density adjacent to its outer surface than in said inner core thereof.

2. The structural member according to claim 1, wherein said plastic fill material comprises polyester.

3. The structural member according to claim 1 wherein said outer surface has a greater density than said inner core.

4. The structural member according to claim 1 formed by an extrusion process.

5. The structural member according to claim 1 formed by a rotary molding process.

6. The structural member according to claim 1, which comprises a component of a utility pole assembly.

7. The structural member according to claim 6, wherein said component comprises a crossarm.

8. The structural member according to claim 6 wherein said component comprises a pole.

9. The structural member according to claim 6 wherein said component comprises a brace.

10. The structural member according to claim 6 wherein said component comprises an insulator.

11. The structural member according to claim 1, which comprises a railroad tie.

12. A plastic structural member, which comprises:

(a) a polypropylene homopolymer base material;

(b) chopped, glass fibers mixed with the base material;

(c) light stable pigments mixed with the base material;

(d) a UV inhibitor mixed with the base material;

(e) an antioxidant additive mixed with the base material;

(f) an endothermic, gas-producing agent mixed with the base material; and (g) recycled plastic material mixed with the base material.

13. The structural member according to claim 12, which includes a hollow core.

14. The structural member according to claim 12, which includes a foam core.

15. The structural member according to claim 12, which includes a longitudinally-extending fiberglass reinforcing rod co-extruded with said structural member and imbedded in same.

16. The structural member according to claim 1, which includes:

(a) said structural member having a generally rectangular-cross configuration with four comers and four longitudinally-extending edges each located adjacent to a respective corner; and (b) four said fiberglass reinforcing rods each located in proximity to a respective structural member edge.

17. The structural member according to claim 15, which includes:

(a) a bottom wall; and (b) a plurality of said fiberglass reinforcing rods co-extruded with said structural member and embedded in said bottom wall thereof.

* * * * *